United States Patent [19]

Peck et al.

[11] 4,420,552

[45] Dec. 13, 1983

[54] METHOD OF PRODUCING PRINTED IMAGES WITH A COLOR FACSIMILE PRINTING DEVICE

[75] Inventors: Richard M. Peck, 3113 Club Dr., Allentown, Pa. 18103; Robert B. Reif, Grove City; Loren R. Albrechtson, Columbus, both of Ohio

[73] Assignee: Richard M. Peck, Allentown, Pa.

[21] Appl. No.: 460,720

[22] Filed: Jan. 25, 1983

Related U.S. Application Data

[62] Division of Ser. No. 244,523, Mar. 16, 1981, Pat. No. 4,390,614.

[51] Int. Cl.[3] ..... G03C 11/12; G03C 1/40

[52] U.S. Cl. ..... 430/252; 430/403; 430/404

[58] Field of Search ..... 430/252, 403, 404, 496

[56] References Cited

U.S. PATENT DOCUMENTS

| | | | |
|---|---|---|---|
| 2,596,754 | 5/1952 | Yackel | 430/252 |
| 3,351,948 | 11/1967 | Bonn | 430/945 |
| 3,359,059 | 12/1967 | Gagliardi | 8/72 |
| 3,469,982 | 9/1969 | Celeste | 96/35.1 |
| 3,511,178 | 5/1970 | Curtin | 101/450 |
| 3,565,618 | 2/1971 | Marechal | 430/252 |
| 3,587,465 | 6/1971 | Barlett | 101/457 |
| 3,630,729 | 12/1971 | Bach et al. | 96/1.2 |
| 3,687,865 | 8/1972 | Kadayama et al. | 252/316 |
| 3,758,302 | 9/1973 | Grohe | 96/2 |
| 3,945,830 | 3/1976 | Yazawa et al. | 96/75 |
| 3,993,831 | 11/1976 | Vassiliades | 428/307 |
| 4,307,165 | 12/1981 | Blazey et al. | 430/496 |
| 4,362,805 | 12/1982 | Whitmore et al. | 430/200 |

FOREIGN PATENT DOCUMENTS

| | | |
|---|---|---|
| 2261189 | 6/1973 | Fed. Rep. of Germany . |
| 80/01614 | 8/1980 | PCT Int'l Appl. . |

OTHER PUBLICATIONS

Chem. Abst., vol. 79, No. 93149z.
Chem. Abst., vol. 89, No. 60997c.

*Primary Examiner*—Richard L. Schilling
*Attorney, Agent, or Firm*—Lane, Aitken & Kananen

[57] ABSTRACT

A method for producing printed images includes the steps of exposing a printing device to radiation, developing a photosensitive ink that is contained in the printing device, and transferring the ink to a substrate. The printing device comprises a printing element and the photosensitive ink. The printing element comprises pores having openings at a printing surface of the element, and the ink is disposed within the pores and is restricted from lateral movement within the element.

16 Claims, No Drawings

METHOD OF PRODUCING PRINTED IMAGES WITH A COLOR FACSIMILE PRINTING DEVICE

This is a division of application Ser. No. 244,523 filed Mar. 16, 1981 and now U.S. Pat. No. 4,390,614.

BACKGROUND OF THE INVENTION

The present invention relates to color facsimile printing devices and their manufacture, and to a method for printing images. The printing devices covered by this invention are suitable for a broad range of applications which include identification, novelty, duplicating and short-run printing, and photographic film uses.

In heretofore known systems for producing images from printing elements, thermoplastic crazing, electrophotographic processes, and processes which provide for the production of single images have been described. For instance, in U.S. Pat. No. 3,587,465 issued to Bartlett, a thermoplastic layer of a printing master is provided with surface deformations by means of crazing. The deformations preferably traverse the thermoplastic layer to contact printing ink or a dye solution which may be disposed in an intermediate layer which is adjacent to the thermoplastic layer. The thermoplastic layer may contain a photoconductor to permit the use of the matters in positive image formation.

U.S. Pat. No. 3,630,729, issued to Bach, describes an electrophotographic process which employs a receptor provided with a number of photoconductive coatings, each of which contain a binder, a photoconductor, a sensitizing component, and a soluble dye compound. Color copies are produced from multicolor originals when copy sheets are pressed into contact with the receptor to thus activate a toner which effects transfer of the dye color to the copy sheets.

U.S. Pat. No. 3,758,302, issued to Grohe, discloses a single impression multicolor printing device comprising a base layer upon which are adhered a randomly dispersed layer of microbeads. The microbeads are coated with a light-sensitive material and a photographic color filter. The printing process comprises exposing the printing device through color separation negatives, processing, and contacting the developed plate with an ink which contains a second component of a color former, thus forming a primary color which can be transferred to a transfer sheet.

None of the aforementioned patents describe printing devices and processes for producing printed images which involve the exposure of a photosensitive ink that is disposed in capillary or cup-shaped pores of a printing element. For this and other reasons which will be readily apparent from the following, the present invention offers advantages over the prior art that include the ability to print images with greater convenience and less complexity.

SUMMARY OF THE INVENTION

It now has been surprisingly discovered that a more advantageous means for printing images is realized by providing a color facsimile printing device which comprises a porous printing element having capillary or cup-shaped pores which are filled with a photosensitive ink. Lateral migration of the ink is prevented by the capillary or cup-shaped construction of the printing element.

The printing element is preferably flexible and compressible so that, once the ink is exposed and developed, a full color print can be readily transferred to a substrate when the printing element and substrate are pressed into contact with each other. The exposed ink can also be developed after the ink has been transferred to the substrate.

Thus, the improved printing element of this invention provides a simple and convenient means for producing multiple full color images which are suitable for identification, novelty, duplicating and short-run printing, and photographic film uses.

DESCRIPTION OF THE PREFERRED EMBODIMENTS

The printing element which retains the photosensitive ink can be an ink pad, printing master, or film and is provided with a porous construction to control lateral migration of the ink. The printing element can be opaque, but is preferably optically transparent. The element is preferably flexible to allow good contact to be made when the printing element is pressed against the substrate to be printed. Preferably, the printing element will also exhibit some degree of compressibility, in order to assist in squeezing ink therefrom.

Lateral migration of the ink can be controlled by providing capillary or cup-shaped pores which are open at any surface from which the ink is desired to flow. The pores can be longitudinally disposed approximately perpendicularly to the printing surface of the printing element. The number and size of the pores will determine the resolving power and the quality of the printed image. Fine pores closely spaced are needed to produce high resolution and good tone and color reproduction. While the printing element can be provided with any number of pores per linear inch, depending on the requirements of the particular application, 80 to 200 pores per linear inch often will be suitable.

The number of prints that can be made from the printing element will depend on the amount of ink that the element can hold. Thus, a relatively thick printing element consisting of fine capillary tubes would be preferable when a large number of prints is desired.

Various types of materials can be used in the manufacture of the printing element. Open cell elastomeric materials such as polyurethane foam which has been laterally compressed may sufficiently restrict lateral porosity for a particular application. Polyethylene sheet, such as that described in U.S. Pat. No. 3,865,674, issued to Duling et al., also may be suitable when laterally compressed. Films such as Nucleopore polycarbonate film provide structures with unidirectional pores which may be suitable for a number of applications.

The printing element also may be produced by photoprinting and etching gravure-type cups in an elastomeric-type polymer. Suitable components for the manufacture of printing elements by this technique include Flex-Light, a photoprintable elastomer made by Uniroyal Inc.; Cyrel, a photoprintable elastomer made by E. I. DuPont de Nemour and Co.; and Riston 30 S, an acrylic resin photoresist covered by U.S. Pat. No. 3,469,982, issued to Celeste, also made by E. I. DuPont de Nemour.

The color producing ink must have photosensitivity and mobility that permits transfer from the printing element to any substrate. When printing on plain paper rather than a special surface is desired, large quantities of color producing ink, relative to the quantities of dye used in dye transfer processes, must be transferred.

Preferably, the ink comprises a mixture of three types of color producing particles in a liquid vehicle. Each particle can consist of an emulsion containing a silver halide salt, a dye coupler to produce a specific color, and an appropriate filter for that color so that each particle responds to the particular frequency of light in the exposure. Color sensitizers can be added to accelerate the photochemical destruction of the filter dyes by oxidation or reduction. Vehicles, such as water soluble oils, which do not dissolve the individual particles but are miscible with the water soluble developers that supply the ions to develop the colors in the particles, can be employed.

Since this ink is essentially a pigment system, the pores in the printing element must be sufficiently large to prevent plugging of the printing element. It is possible that the particles can be dissolved after color development in each particle is completed. Alternatively, the color system can be entirely dry in the printing element and only the substrate solubilized or mobilized for each print.

Suitable emulsion can be prepared from single color liquid emulsions such as Liquid Light, made by Rockland Colloid Corp., or by a number of water soluble polymers such as methyl cellulose, Tragacanth gum, algin, polyvinyl alcohol, hydroxyethyl cellulose, mannitol, polyethylene glycol (Carbowax 4000), and sucrose. Particularly preferred particles may be produced by spray-drying emulsions containing 5% methylcellulose or 1% Tragacanth gum.

Suitable silver halide salts are exemplified by light sensitive silver bromide salts made by reacting silver nitrate with potassium bromide in aqueous solutions, as described in the following reference: Glafkides, P., *Photographic Chemistry,* Volume 1, Fountain Press, London, (1958); Glafkides, P., *Photographic Chemistry,* Volume 2, Fountain Press, London, (1960); Baker, T., *Photographic Emulsion Technique,* American Photographic Publishing Co., Boston (1941); and Burbank, W. H., *The Photographic Negative,* Scovill Manufacturing Co., New York (1888).

Couplers that are suitable in the practice of this invention are very numerous. When a full color process is desired, cyan, yellow and magenta couplers are required.

Typical cyan couplers suitable in the practice of this invention include cresols, thymols, 1-naphthols, thiophenols, and selenophenols, all of which are formed by condensation of substituted p-phenylenediamines with phenolic compounds to produce blue indophenols. An increase in the molecular weight of the phenol produces a shift to the green. 1-naphthol and dimethyl-p-phenylenediamine are blue violet while dichloro-1-naphthol is clear blue. Specific cyan couplers which may be employed include: 1-naphthol; 1-thionaphthol; 2:4-dichloro-1-naphthol; 3:5-dibromo-o-cresol; 4-chlorophenyl-phenol; m-hydroxybiphenyl; 5:7-dibromo-8-hydroxyquinoline; Dihydroxydiphenylmethanes; 1-hydroxy-2-naphthoyl-o-chloranilide; p-nitrobenzylpyridinium chloride; 3-hydroxyguanazopyrazolone.

Yellow couplers are compounds with a reactive methylene group of the type $$R—CO—CH_2—CO—R',$$

and suitable yellow couplers for the practice of the present invention include anilides, malonic hydrazines, malonic diamides, and heterocyclic ketomethylene compounds. Acetoacet-2:5-dichloroanilide is a preferred coupler. The benzoylacetanilides can be used with various radicals attached to the extreme benzene nuclei of the molecule in the form:

$$R—C_6H_4—CO—CH_2—CO—NH—C_6H_4R$$

and include benzoylacet-p-chloranilide, the m- and p-aminobenzoylacetanilides, m-aminobenzoylacet-p-bromanilide, and p-methoxybenzoylacet-m-dialkylanilide. Malonic hydrazide condensed in alcohol with two molecules of acetoacetic ester gives the yellow coupler malonyldihydrazone of acetoacetic ester:

$$C_2H_5—O—CO—CH_2—C(CH_3)=N—N—H—CO—CH_2—CO—NH—N=C(CH_3)—CH_2—CO—O—C_2H_5$$

An assymetrical dihydrazone, o-hydroxybenzaldehyde and o-chlorobenzaldehyde, gives yellow to golden-yellow images. Other hydrazones with the structure $$C_6H_5—CH=N—NH—CO—CH_2—CO—O—C_2H_5$$

also give yellow images. Malonic diamides with thiazole or benzthiazole nuclei on the nitrogen atoms such as the symmetrical malonic amide of 2-amino-benzthiazole is a preferred yellow coupler. Heterocyclic ketomethylene compounds such as the carbothoxy and carbohydrazino derivatives of quinazolene and the carbohydrazinomethylene derivative of ethyl oxodiazoylacetate also are particularly suitable.

Suitable magenta couplers belong to four main groups: phenylacetonitriles, cyanacetylureas, cyanacetylhydrazones and pyrazolones. Phenylacetonitriles include p-nitrophenyl-acetonitrile (or p-nitrobenzyl cyanide) and derivatives such as benzoylacetonitrile and p-phenylbenzoylacetonitrile. Cyanacetylureas have the structure $$R—NH—CO—NH—CO—CH_2—CN.$$

Cyanacetylhydrazones have the structure $$R=N—NH—CO—CH_2—CN.$$

The R can be indazolone. The pyralzolones include 1-phenyl-3-methyl-5-pyrazolone, 1-phenyl-3-amino-5-pyrazolone, bis-pyrazolones, imino-bis-pyrazolones, and 3-amino-pyrazo-coumarazone. Other heterocyclic magenta couplers can be oxindoles and indazolones.

The filter material suitable for use in the present invention can be a decolorizable dye which is destroyed photochemically, generally by oxidation or reduction. The dyes can be chemical types such as diphenylmethane, triphenylmethane, phthaleins, azines, oxazines, thiazines, indulines, indoanilines, indigoids, cyanines, pyronines, and azo-dyes. Blue, magenta, and yellow dyes are required in a full color system. The following are examples of suitable blue photochemical dyes: Capri blue; Nile blue; Victoria blue; Dianile blue, B, R, 4R; Methylene blue; Columbia blue; Cresyl blue 2BS; Meldola blue; Rosinduline blue; Direct blue 2B and 3B; Naphthylamine blue; Trypan blue; Chicago blue; Chicago blue 2R; Carbocyanines; Dicarbocyanines; Setoglaucine; Erioglaucine; and Indigos. Examples of suitable magenta photochemical dyes include Rosinduline 2B; Bluish safranines; Rhodamine B and 6G; Rhodamine S; Rosanilines; Fuchsine; Benzopurpurin 4B; Bluish eosin; Erythrosin; Bengal pink; Selenopyranine; Thiopyranine 6G; Isocyanines; Thiacarbocyanines; Selenacarbocyanines; a-hydroxyglutaconic dialdehyde dianil (HCl); and Thioindigos. Yellow photochemical dyes which are suitable in the practice of this invention include: Auramine O and G; Fluorescein; Thiofluorescein; Naphthol yellow; Flavinduline O; Thioflavine T; Thioflavine S; Thiazol yellow; Resorcinol benzoins such as the hydrochloride of the methoxy or fluoborate derivative of the dimethyl ether; Euchrysin; Oxonium derivatives such as 3:6-dihydroxy-9-phenyl xanthonium; and Thiacyanines.

Sensitizers can be suitably selected to act in conjunction with particular filters. Victoria violet, eosin, erythrosin and chlorophyll are rapidly bleached in the presence of linoleic acid, oleic acid, or ergosterol. The reduction of methyl red in the presence of phenylhydrazine is catalyzed by chlorophyll. Methylene blue and uranine are decolorized in glycerin to give the leuco derivatives. The active sensitizers contain either a —CH=CHR group as in anethole or a >C=S group as in thiosinamine.

Anethole and thiosinamine are the most active sensitizers known. Thiosinamine or allylthiourea is a derivative of thiourea in which one hydrogen atom is replaced by an allyl, $CH_2=CH—CH_2$ radical. The most active allylthiourea is diethylallylthiourea. The reducing action develops when the two hydrogens attached to nitrogen opposing an allyl group are blocked by alkyl groups. The last free hydrogen reduces the dye in the photochemical reaction. To provide water solubility, hydroxyl groups are introduced to form compounds of the general type $$R_1R_2{:}N—CS—NH—CH=CHR$$

in which at least one of the groups $R_1$ and $R_2$ contain OH. Examples are N-β-hydroxyethyl-N'-allylthiourea and N-diβ-hydroxyethyl-N'allylthiourea.

After the liquid emulsion has been produced, a suitable means is employed to particulate the emulsion to form particles that isolate the basic colors needed in a full-color ink. Appropriate particulating techniques can include microencapsulating fine droplets of the photosensitive liquid emulsion, drying the liquid emulsion to a solid and grinding, or spray drying the liquid emulsion.

Printing pastes are prepared by mixing the particles with a suitable vehicle which can be a water-soluble oil such as glycerine or Corn Huskers Lotion (a product of Warner-Lambert Co.). The pastes are then deposited in the pores of the printing element.

Non-drying oil-type vehicles, such as glycerine and Corn Huskers Lotion, require absorption in a porous substrate. A paste made with drying-type vehicles is preferred for applications requiring high print quality and durability, or transfer to substrates that do not have absorptive surfaces.

The photosensitive printing device of this invention can be exposed through a negative with radiation from an appropriate source. After a suitable exposure time has elapsed, the exposed paste either can be transferred onto a substrate and developed or developed in the printing plate and then transferred to the substrate. The prints then can be stopped and fixed with standard photographic chemicals.

When development of the exposed paste is desired to take place while disposed in the printing element, development can be effected by techniques which include immersing of the printing element in the developer, doctoring the developer onto the surface of the printing element, or placing filter papers or other porous substrates soaked in developer on the printing element. Improved transfer of the paste from the pores can be made possible by converting the color particles to a soluble form following development.

When development of the exposed paste is desired to take place after the paste is transferred to the substrate, a preferred method involves saturating the substrate with the developer and then bringing the saturated substrate into contact with the exposed paste. Prints can also be made directly on the substrate after exposure of the paste in the printing element, followed by immersing the substrate in a suitable developer. Alternatively, a print that is made directly on a porous substrate, such as paper, can be developed by allowing the developer to soak through from the back of the substrate to the surface upon which the print has been made. After development, stopping and fixing clears the unexposed areas and stops further color development.

Examples 1 through 3 illustrate the manufacture of stamp pads by etching techniques according to the present invention:

EXAMPLE 1

Plates were made with Flex-Light, a photoprintable elastomer made by Uniroyal, Incorporated. The Flex-Light was hardened by ultraviolet light, and unexposed areas were washed out with tetrachloroethylene. Small samples of the 0.112 gauge sheet material were photoprinted with a 175-line gravure screen with a 3.2 to 1 cell-to-wall ratio and a 90-line gravure screen with a 5 to 1 cell-to-wall ratio. The fine screen produced cups that were about 0.004 inch wide while the coarse screen produced cups that were about 0.009 inch wide. The cup depths were about 2 to 3 mils which can be sufficient for one or two prints.

EXAMPLE 2

Several plates were made with Du Pont Cyrel plate material. Cyrel is a photoprintable elastomer that is washed out with a mixture of n-butyl alcohol and perchloroethylene. The plates were photoprinted with 90, 120, and 150-line screens and etched in a commercial machine. The cups of the etched plates were about 3 mils deep.

EXAMPLE 3 A 9-mil film formed with three layers of 3-mil Riston 30 S photopolymer resist was photoprinted with a 33-line screen to form a positive cup pattern. After development, the walls between the cups were filled with an elastomeric material such as Silastic J-RTV Mold Making Rubber, a polysiloxane rubber that cures at room temperature and is produced by Dow Corning Corporation. The cured rubber was stripped from the resist to make a flexible printing pad with cups that were 9-mils deep. Six prints could be made from a plate.

Examples 4 through 6 illustrate methods for making liquid emulsions for use in the present invention.

EXAMPLE 4

A single color stamp device was produced with Liquid Light. Red and blue dye couplers made by Edwal Scientific, Chicago, Ill., were mixed with Liquid Light in a ratio of 30 parts Liquid Light to one part dye coupler to make a water-compatible ink of printable consistency that readily accepts developer. The ink was doctored into a 33-line plate, exposed, developed, and transferred to paper. Three successive prints were achieved from a plate with 9-mil deep cups.

EXAMPLE 5

A light sensitive emulsion using a water soluble polymer which can be spray dried to make the desired color developing particles was produced in this experiment. Thus, 400 cc aqueous solutions containing 5% methylcellulose, 8 grams silver nitrate, and 6 grams potassium nitrate were prepared. Eleven cc's of red dye coupler was added and the resulting emulsions were spray dried from plain water solutions using an atomizing rate of about 15 cc's/minute. Products with particles in the range of 10 to 20 microns were produced. The particles were photosensitive and developed color properly. Printing pastes were formed by mixing the powders with a water soluble oil such as glycerine or Corn Huskers Lotion. In order to make the color particles respond correctly to the appropriate frequency of incident light, color sensitizers and filters must be incorporated according to conventional technology known to one having ordinary skill in the art.

EXAMPLE 6

This experiment followed the procedures set forth for Example 5, except that 1% Tragacanth gum was substituted for the 5% methylcellulose. The results were also the same as those discussed in the preceding example, except that the size of the particles was 1 to 2 microns as opposed to 10 to 20 microns.

Examples 7 and 8 demonstrate the use of the printing element in a printing process.

EXAMPLE 7

A series of experiments were conducted using printing pastes which were made by mixing the particles of examples 5 or 6 with glycerine. The pastes were doctored into printing plates having 33-lines-per inch and 90-lines-per inch patterns. The resultant photosensitive printing surface was exposed through a negative with light from a 120-watt incandescent bulb for ½ to 2 minutes. The substrate to be printed was saturated with Edwal color developer or with Kodak Process 122 Developer. The first transfer was made to the saturated substrate and the pastes in the pores also were developed such that successive prints could be made on other sheets of plain paper. After developing for three to five minutes, standard stopping and fixing solutions, Kodak Process 122 stop bath and hardener fixers were introduced. Edwal Color fixer was employed in some of the runs. As in conventional photography, stopping and fixing for 30 seconds each clears the unexposed areas and stops further color development. Up to six prints were made from the 33-line printing pad with a single exposure.

EXAMPLE 8

Another series of experiments followed the procedures outlined in Example 7 except that the prints were made directly on paper following exposure of the photosensitive paste in the printing plate. The paper was then contacted with developer, and the least amount of blurring occurred when the developer was allowed to soak through from the back side of the sheet.

The examples have demonstrated the isolation of a single color in individual particles throughout the process. It will be readily apparent to one having ordinary skill in the art that a full color system can be devised by preparing a mixture with equal amounts of such particles with separate red, yellow and blue dye couplers. Appropriate dye sensitizers and filters are incorporated in the particles to complete the system.

In use, the printing element can be mounted on an impervious backing before or after exposure. The backing can be maintained adjacent to said element by any suitable means, including a pressure sensitive adhesive or pressure exerted by a stamping device. In turn, the backing, or the element directly, can be mounted on a stamping device. The printing element can be provided with a removable dark cover and can be exposed and developed in a camera.

A printing element according to this invention that is capable of producing high quality prints, optionally with the aid of a special paper substrate, can be suitable for making color photographs. An ink that can be exposed by visible light at high speeds can enable use of the invention in hand-held cameras. The dark cover can be a camera shutter or can be a thin light or radiation-impermeable material that is coterminous with the printing surface of the printing element.

A porous element capable of retaining a large volume of photosensitive ink can be suitable for duplicating and short-run printing applications.

The identification uses of the present invention include identification of participants in business transactions, as for example identification of the person tendering a check. Personal articles and stationery can also be identified.

It will be understood that changes may be made in the details of the invention without departing from the spirit of the invention, especially as defined in the following claims.

We claim:

1. A method of producing printed images comprising the steps of (1) exposing a printing device to radiation, said printing device comprising a printing element and a transparent photosensitive ink wherein said printing element comprises pores having openings at a printing surface of said element and said ink is disposed within said pores and is restricted from lateral movement within the element, (2) developing said photosensitive ink, and (3) transferring said ink to a substrate.

2. A method of producing printed images comprising the steps of (1) exposing a printing device to radiation, said printing device comprising a printing element and a transparent photosensitive ink wherein said printing element comprises pores having openings at a printing surface of said element and said ink is disposed within said pores and is restricted from lateral movement within the element, (2) transferring said ink to a substrate, and (3) developing said ink.

3. The method of claim 1 or claim 2 further comprising stopping the development of said ink.

4. The method of claim 3 further comprising fixing said ink.

5. The method of claim 1 wherein the developing step comprises immersing said printing device in a developer.

6. The method of claim 1 wherein the developing step comprises doctoring a developer onto said pores.

7. The method of claim 1 wherein the developing step comprises placing filter papers or other porous substrates soaked in a developer on said printing element.

8. The method of claim 1 further comprising making said ink and a vehicle carrying said ink more soluble after said developing and before said transferring.

9. The method of claim 2 further comprising saturating said substrate with a developer before said transferring.

10. The method of claim 2 wherein said developing step comprises immersing said substrate in a developer.

11. The method of claim 2 wherein said developing step comprises allowing a developer to soak through from a surface of said substrate to a second surface of said substrate, said second surface being the surface upon which said ink is transferred.

12. The method of claim 1 or claim 2 wherein said radiation is visible light.

13. The method of claim 1 or claim 2 wherein said printing device is provided with a dark cover removably covering said printing surface and said method further comprises removing said cover prior to said exposing.

14. The method of claim 13 wherein at least said exposing step takes place in a camera.

15. The method of claim 1 or claim 2 wherein said exposing step comprises placing a negative between a radiation source and said printing device.

16. The method of claim 1 or claim 2 wherein said ink comprises a vehicle and said transferring step is assisted by said vehicle.

* * * * *

Disclaimer and Dedication 4,420,552—*Richard M. Peck*, Allentown, Pa.; *Robert B. Reif*, Grove City; *Loren R. Albrechtson*, Columbus, both of Ohio. METHOD OF PRODUCING PRINTED IMAGES WITH A COLOR FACSIMILE PRINTING DEVICE. Patent dated Dec. 13, 1983. Disclaimer and Dedication filed Dec. 6, 1990, by the inventor.

Hereby disclaims and dedicates to the public the remaining term of said patent.

[ *Official Gazette June 4, 1991* ]